United States Patent [19]

Mally

[11] Patent Number: 4,457,194

[45] Date of Patent: Jul. 3, 1984

[54] SLICING METHOD AND APPARATUS

[75] Inventor: Timothy G. Mally, Oregon, Wis.

[73] Assignee: Oscar Mayer Foods Corporation, Madison, Wis.

[21] Appl. No.: 306,417

[22] Filed: Sep. 28, 1981

[51] Int. Cl.[3] ..... B26D 3/00

[52] U.S. Cl. ..... 83/42; 83/79; 83/157; 83/409; 83/417; 83/437; 221/112; 221/298; 414/222

[58] Field of Search ..... 83/42, 355, 409, 402, 83/437, 262, 277, 278, 281, 417, 157, 79, 4; 414/222, 751, 14, 18; 198/486; 221/298, 112; 226/115

[56] References Cited

U.S. PATENT DOCUMENTS

| | | | |
|---|---|---|---|
| 1,289,516 | 12/1918 | Mulder | 83/277 |
| 2,832,388 | 4/1958 | Folk | 83/277 |
| 3,847,320 | 11/1974 | Scribner | 226/115 |
| 3,880,295 | 4/1975 | Wyslotsky | 83/409 |
| 3,954,164 | 5/1976 | Bottomley | 198/486 |
| 4,015,494 | 4/1977 | Spooner et al. | 83/409 |
| 4,051,987 | 10/1977 | Scribner | 226/115 |
| 4,060,875 | 12/1977 | Gosling et al. | 83/278 |
| 4,147,259 | 4/1979 | Nilsson | 198/486 |
| 4,283,974 | 8/1981 | Kline | 83/280 |
| 4,289,254 | 9/1981 | Spring | 221/298 |
| 4,321,847 | 3/1982 | Dillon | 83/278 |

*Primary Examiner*—Frank T. Yost
*Assistant Examiner*—Hien H. Phan
*Attorney, Agent, or Firm*—Lockwood, Dewey, Alex & Cummings

[57] ABSTRACT

An apparatus and method are disclosed for slicing elongated products, such as sausages. A pair of product engaging members are driven simultaneously in opposite directions so that one member can feed the product to a slicer while the other member is returning to the start position. A magazine may be provided for storing a supply of products and automatically discharging the product in timed relationship with the product engaging members. In addition, the product engaging members may have tines for gripping the product during feeding to the slicer and for releasing the waste end of the product during the return stroke.

24 Claims, 15 Drawing Figures

20
22
36
46
48
50
A
B
2
5
6
7

SLICING METHOD AND APPARATUS

The present invention relates to a method and apparatus for slicing elongated products, especially food products such as sausages. More particularly, the present invention relates to a method and apparatus for feeding a succession of product to a slicing apparatus without substantial interruption or delay between individual products.

In the production of sliced sausages (such as luncheon meat, bologna, salami, etc.), a common practice is to prepare the sausages in an elongated form of uniform cross-section which are fed through a high-speed slicer to provide the substantially uniform slices which are packaged for sale in the supermarket. In a typical slicer used in high volume production, each sausage is manually placed in a receiving channel, with a high-speed rotating blade at one end of the channel, towards which the sausage is fed. The feeding is achieved by a pushing member, which engages against the end of the sausage opposite the blade, and pushes the sausage towards the rotating slicer blade. After substantially all of a sausage is sliced, with only the butt-end being retained by the pusher. The butt-end is then manually removed, and another sausage is manually placed into the receiving channel for slicing.

Although in known production slicing machinery, the time required for retraction of the pusher before a new sausage can be inserted may be only a matter of a few seconds, this represents a significant portion of the overall slicing cycle for the apparatus. In addition, the manual loading of each sausage, plus the required removal of the butt-end of the sausage from the pusher, requires substantial attention by an operator.

Accordingly, an object of the present invention is to provide a method and apparatus for feeding elongated products to a slicing apparatus without substantial delay or interruption between individual products.

A further object of the present invention is to provide a method and apparatus for the automatic and continuous feeding of products to a slicing apparatus to minimize the operator time which must be devoted to the slicing operation.

A further objection of this invention is to provide a slicing method and apparatus for discharging the butt-end of the product to minimize the operator time which must be devoted to removing the butt-end.

These and other objects will become apparent from the following detailed description of this invention.

The present invention provides a slicing apparatus having an elongated product cradle or support for receiving and supporting a product, slicing means at one end of the product support for slicing the product as the product is fed to the slicing means, and a product feeder means in the form of a pair of product engaging members, each of which is movable alternately and automatically into registration with the product support for feeding the product to the slicer and out-of-registration with the product support for returning to the starting positions. Drive means move the product engaging members simultaneously in opposite directions so that one of the product engaging members is returning to the start position while the other is feeding a product to the slicer, thereby allowing a plurality of products to be fed in succession to the slicing means without any substantial delay for return of the product feeder means.

In accordance with another aspect of the present invention, a magazine is provided which is capable of holding a plurality of products and includes means for automatically discharging or releasing each product onto the product support in timed relationship to the movement of the product engaging members, thus eliminating the need for manual loading of each product into the slicing apparatus. In addition, the product engaging members each have gripping tines which are movable between an extended position for gripping the butt-end of the product and a retracted position for releasing the butt-end. The tines are preferably biased to the gripping position, but are automatically retracted during the return stroke of the product engaging member to release the butt-end prior to moving into registration with the product support for the next product.

For purposes of illustration, this invention will be described with regard to a preferred embodiment which provides an apparatus and method for slicing elongated sausage products (such as luncheon meat products in round "stick" form, square or rectangular "loaf" form, etc.).

Referring to these drawings, the present invention is embodied in a slicing apparatus (generally designated 20), and in the method employed by the apparatus, for slicing elongated sticks and loaves of sausages 22 (such as bologna and the like) with minimum wasted time and with minimum operator involvement.

Figure 1:
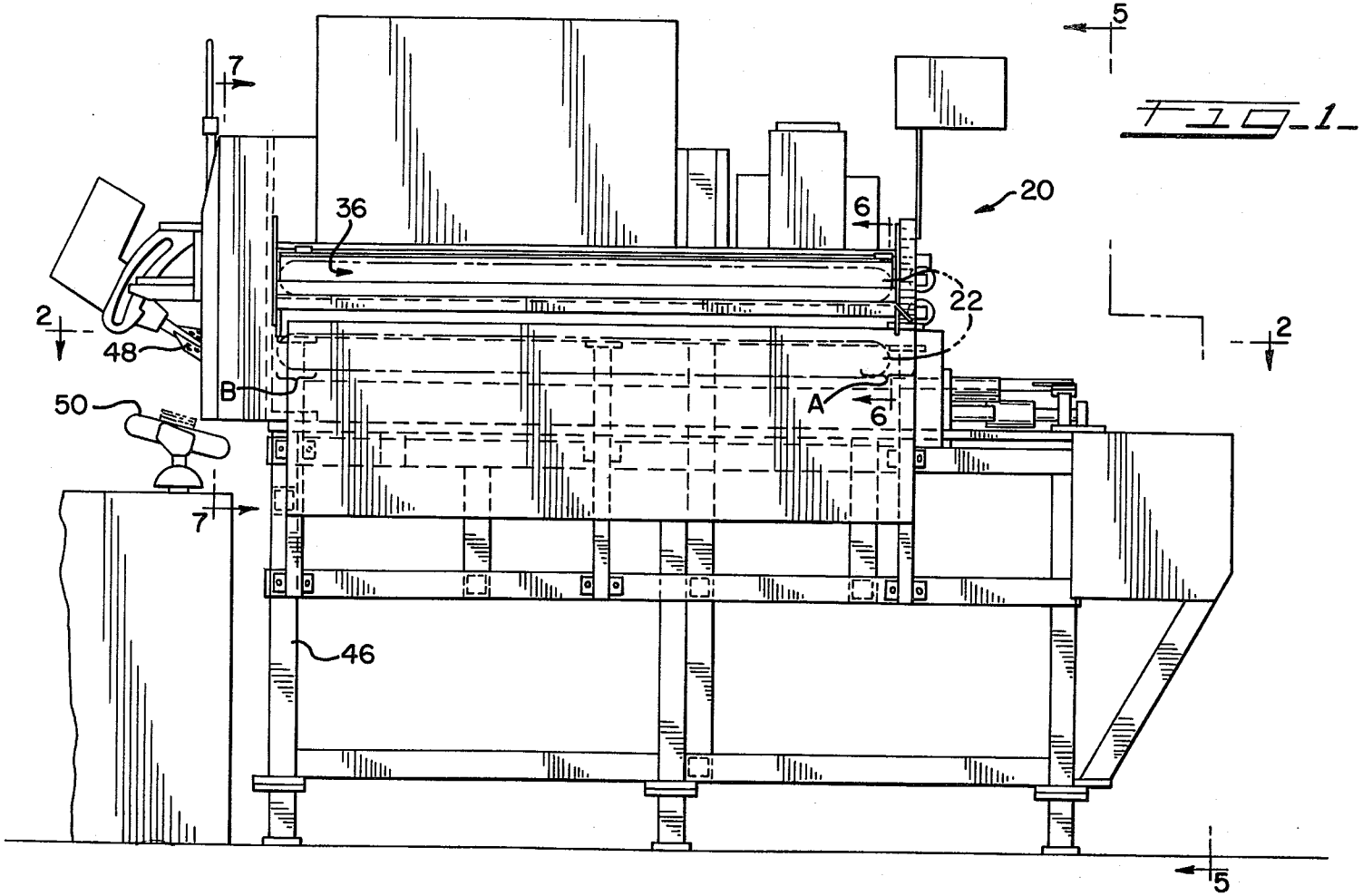
FIG. 1 is a side elevational view of a slicing apparatus embodying the present invention.
Figure 2:
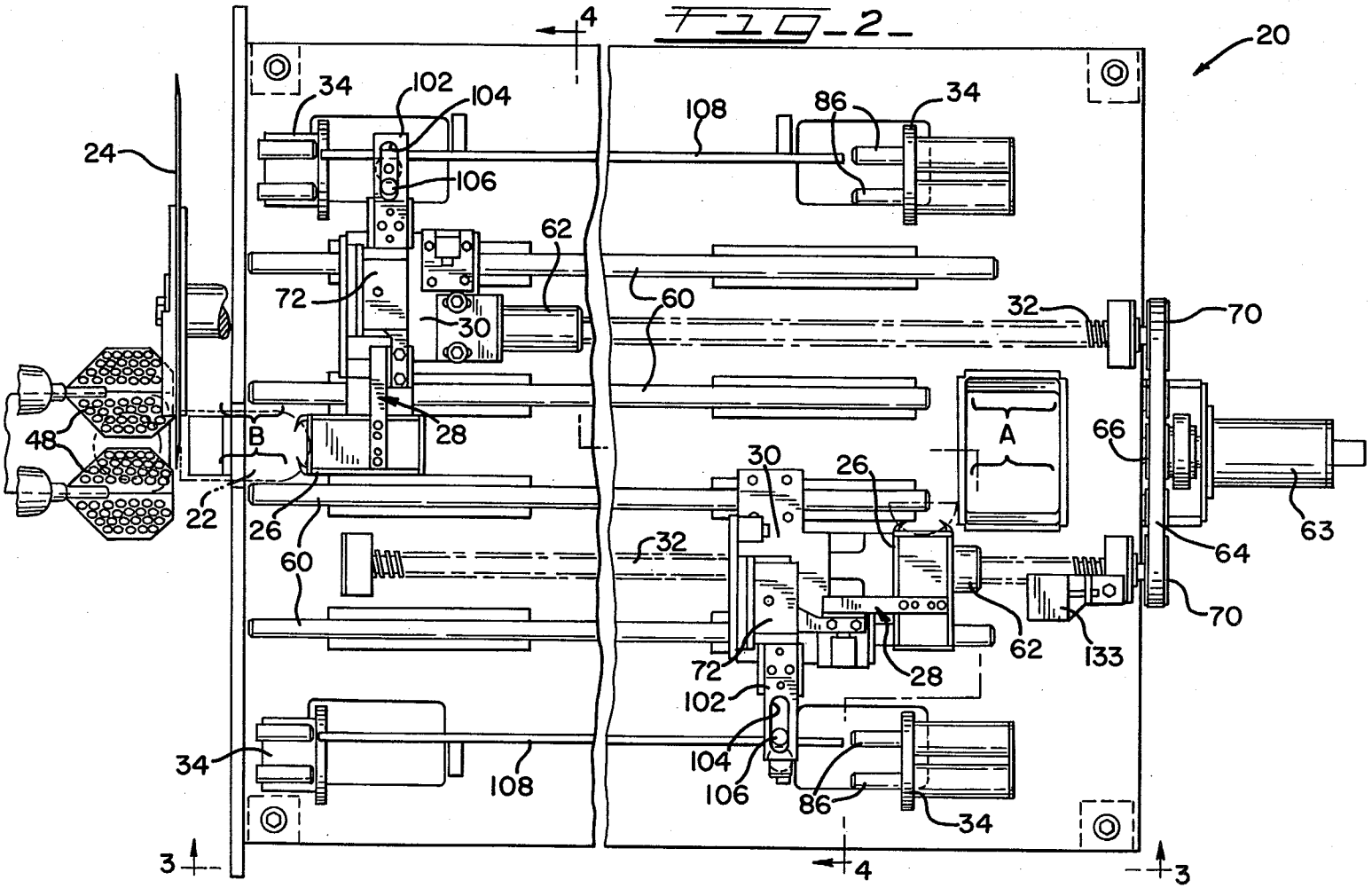
FIG. 2 is a horizontal cross-sectional view taken along lines 2—2 of FIG. 1 and showing in more detail the means for feeding a succession of sausages to a slicer substantially without interruption.

In FIGS. 1 and 2, the sausages 22 are fed to a rotary slicer 24 by one of a pair of sausage engaging members 26 which are movable back and forth between a start position A at the right end of the apparatus 20, and a stop position B adjacent to the slicer at the left end of the machine. Each sausage engaging member is attached to the end of a swing arm 28 which can be pivoted to swing the sausage engaging member into abutment with the end of a sausage at position A or to swing the sausage engaging member out of the way at position B for return to the start position. The swing arms are mounted on carriage 30 which are driven simultaneously in opposite directions between the start and stop positions by drive or lead screws 32. In this way, one sausage engaging member 26 is feeding a sausage to the slicer 24 while the other is returning to the start position, thereby permitting substantially continuous feeding of a succession of sausages without delay for return or retraction of the sausage engaging member. A shifter 34 at each end of the slicing apparatus automatically shifts the sausage engaging member 26 into position or registration for the feed stroke and out of position or registration for the return stroke.

Figure 6:
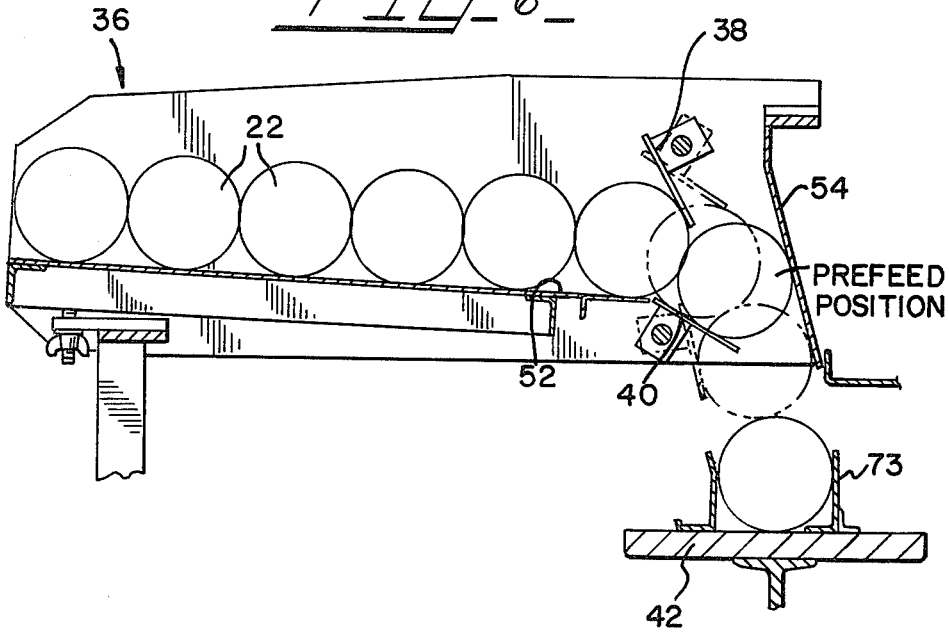
FIG. 6 is a vertical detail sectional view on an enlarged scale taken along line 6—6 of FIG. 1 and depicting the magazine for holding a plurality of sausages and the associated apparatus for automatically discharging sausage into the feeder apparatus.

In addition, referring briefly to FIG. 6, a magazine (generally at 36) is provided for holding a plurality of the sausages 22, and sausage engaging stop members 38 and 40 control automatic discharge of sausages from the magazine into the elongated sausage support cradle or channel 42.

According to a further aspect of the present invention, in FIGS. 12–15, the sausage engaging members 26 engage and grip the butt-end of each sausage with tines 44 which are movable from an extended position (FIG. 13) for gripping the sausage, to a retracted position (FIG. 14) for releasing the butt-end during the return stroke.

Turning now to a more detailed description of the drawings, FIG. 1 is a side elevational view of the overall slicing apparatus 20. An operator platform which would typically be provided along the side of the apparatus for loading of the sausages 22 into the magazine has been removed for purposes of illustration.

The slicing apparatus is mounted on a support frame indicated generally at 46. The general arrangement of the various components of the slicing apparatus 20 is such that the sausage feeding and handling operations are preferably located above substantially all of the associated drive apparatus to insure that no particulate or debris can fall onto the sausages from various moving parts of the apparatus.

Figure 7:
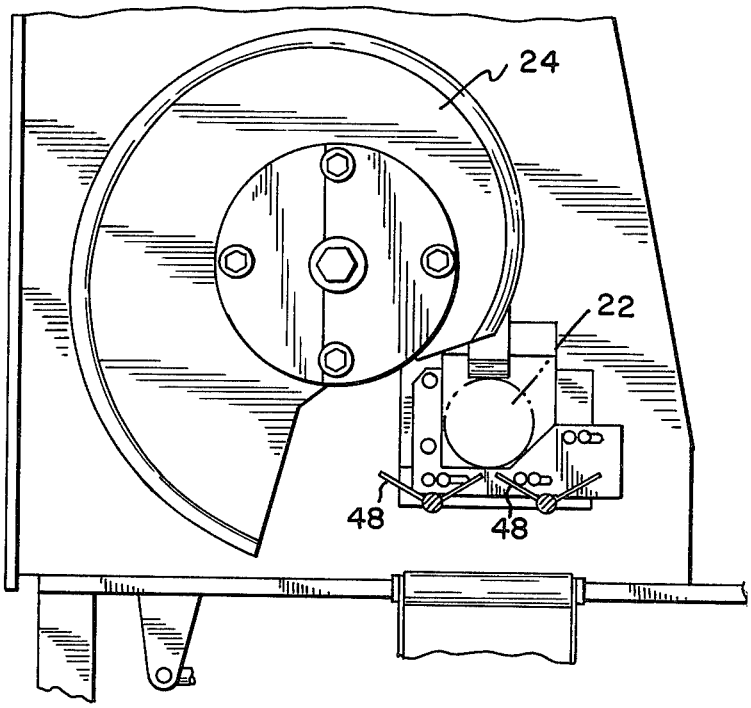
FIG. 7 is a vertical sectional view taken along line 7—7 of FIG. 1 and depicting the rotary slicing blade.

Returning to FIG. 1, the rotary slicer 24, which is of known commercial type, is generally enclosed within a protective housing at the left end of the slicing apparatus, and slices the sausage as the sausage is pushed along the support channel 42 by one of the sausage engaging members. (FIG. 7 is a front end view with the protective housing removed and shows the rotary slicer blade 24 more clearly.) As slices are cut from the sausage, they fall onto a pair or rotating paddle wheels 48, the rotation of which is timed to collect the slices in stacks of desired weight, and upon rotating further, to drop the stack of slices onto a weighing conveyor 50 for verification of the proper weight. The slicing blade, paddle wheels and weighing conveyor are of known commercial type.

Describing the apparatus generally in the order of operation, the sausages 20 are initially loaded by the operator into the side-loading magazine 36, which is capable of holding a sufficient supply of sausages, preferably three or more, so that the operator does not have to monitor the supply constantly.

Although other features of the present invention operate satisfactorily with sausages of a variety of cross-sectional shapes, the magazine 36 is especially adopted to operate with sausages which are generally circular in cross-section and roll under the influence of gravity. This is made more clear by referring to FIG. 6, which shows that the magazine has an inclined bottom wall 52 upon which the full length of the sausages rest, and a rear wall 54 spaced from the rearward edge of the bottom wall a sufficient distance to provide a discharge opening for the passage of sausages onto the sausage support channel 42, which is located beneath the discharge opening. The bottom wall 52 is of sufficient width to hold the desired number of sausages, preferably three or more, and the downward incline causes the sausages to roll toward the discharge opening.

The sausages 22 are automatically fed into the sausage support channel 42 in timed relationship with movement of the sausage engaging members. A new sausage is discharged into the support channel only after the previous sausage has been completely sliced and after the sausage engaging member 26 pushing that sausage has been pivoted out of the way or, in other words, out of registration with the support channel. The feeding of the sausages from the magazine 36 is actually controlled by sausage stop members 38 and 40 which operate alternately to permit one sausage at a time to enter a pre-feed position where the sausage is held in the discharge opening until permitted to fall into the support channel 42. (See the sausage marked "PRE-FEED POSITION" in FIG. 6.)

The stop members may be provided in various sizes or shapes and may be operated in various modes to engage or release the sausages, e.g., pivotal or linear motion. However, stop member 38 is preferably an elongated plate which extends the length of the magazine and is pivotally mounted above the sausages for movement between a position shown in solid lines in FIG. 6 where stop member 38 blocks the second-most and thus also the remainder of the sausages from rolling further down the inclined bottom wall, and a position shown in dashed lines, where stop member 38 releases the second-most sausage to roll into the pre-feed position. Stop member 40 is also a narrow plate which extends the length of the magazine and is pivotally mounted adjacent to and slightly below the rear edge of the bottom wall 52. Stop member 40 is pivotal between a position shown in solid lines in FIG. 6, where stop member 40 partially blocks the discharge opening and prevents the sausage 22 in the pre-feed position from falling into the support channel 42, and the position shown in dashed lines where stop member 40 releases the sausage for discharge into the support channel.

Figure 5:
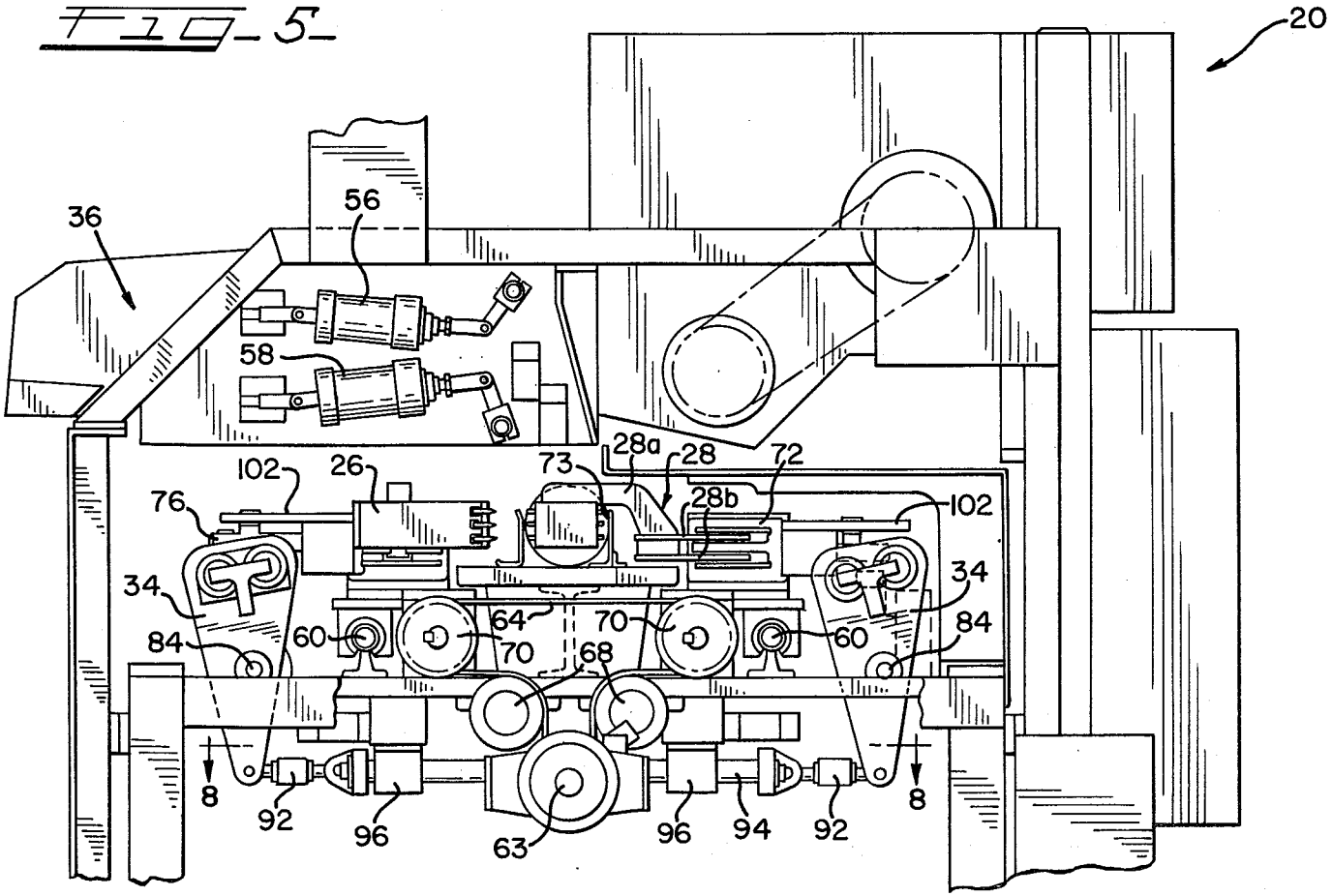
FIG. 5 is an end view of the slicing apparatus of FIG. 1, taken along line 5—5 thereof.

As noted earlier, the stop members 38 and 40 operate alternately to feed or release only one sausage at a time. Referring to FIG. 6 for a description of the operation of the stop members, before either of the stop members is actuated, the sausages are in the position as shown in solid lines, with the stop member 38 restraining the second and later sausages from any further movement, and the stop member 40 preventing the sausage in the pre-feed position from dropping through the discharge opening between the bottom wall 52 and the rear wall 54 of the magazine. When another sausage is needed in the support channel 42, stop member 40 is pivoted to the position shown in dashed lines, permitting the sausage in the pre-feed position to drop into the sausage support channel, and then pivoted back to the blocking position as shown in solid lines. Next, stop member 38 pivots to the position shown in dashed lines, allowing the next sausage to enter the pre-feed position in the discharge opening; the stop member 40 blocks the sausage from falling into the support channel. Stop member 38 then pivots back to the position shown in solid lines, restraining the remaining sausages from feeding into the space between the bottom wall and the end wall. Referring briefly back to FIG. 5, the stop members 38 and 40 are pivoted by air or hydraulic cylinders 56 and 58, respectively, which are mounted on the outside end wall of the magazine 36, away from direct contact with the sausages.

Figure 4:
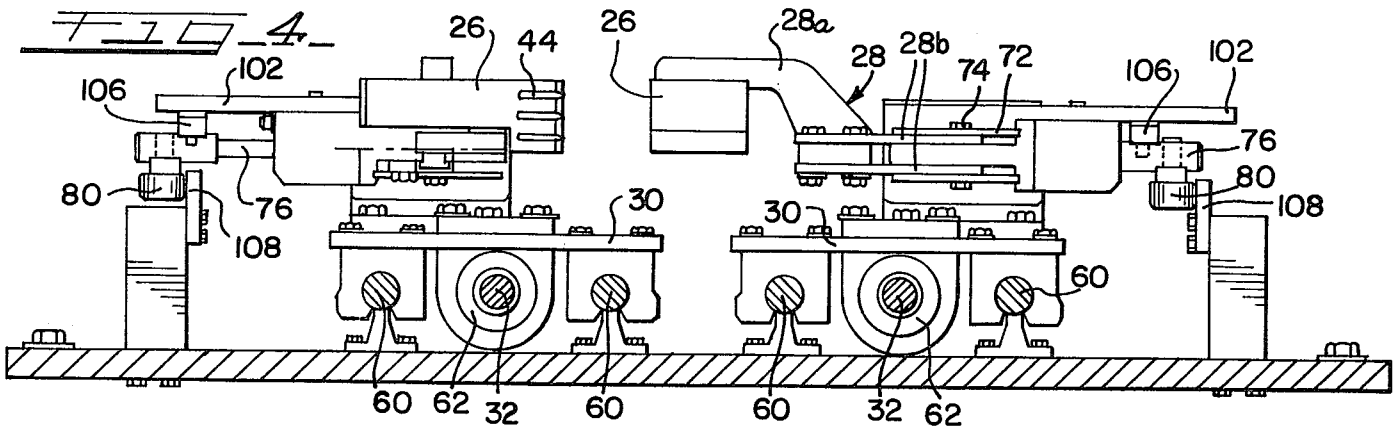
FIG. 4 is a vertical cross-sectional view taken along line 4—4 of FIG. 2.

The sausage which is dropped into the support channel 42 from the magazine 36 is fed to the slicer 24 by one of the sausage engaging members 26. Referring to FIGS. 2 and 4, the sausage engaging members 26 are mounted atop the carriages 30 for movement back and forth between the start and stop positions. Each carriage is, in turn, supported by and slidably movable along a pair of guide bars 60 which extend fore-and-aft in the slicing apparatus and are mounted on the support frame 46. The drive or lead screws 32 also extend fore-and-aft in the apparatus and are positioned between the guide bars 60 and threadedly engaged with followers 62 which depend from the carriages. Preferably, the threaded engagement between each drive screw 32 and follower 62 is of the known low friction, ball bearing type, wherein bearings captured within the follower 62 roll along the grooves in the threaded drive screw 32.

As best seen in FIG. 5, the lead or drive screws 32 are driven by electric motor 63. A drive belt 64 passes around the motor pulley 66, idler pulleys 68 and drive pulleys 70 at the front end of each of the lead screws, so as to drive the lead screws in the same direction. The screws 32 are oppositely threaded so that while one carriage assembly is moving in the return direction, the other carriage assembly is moving in the feed direction. When the carriages reach the start or stop positions, they engage a limit switch (not shown) which reverses the voltage on motor 63, so as to drive the screws in the other direction, and thus reversing movement of the carriage assemblies.

Each swing arm 28, which mounts the end of sausage engaging member 26, is pivotally attached to carriage 30 by an upper bracket 72. Referring to the right hand side of FIG. 4, the swing arm 28 has an upwardly extending outer end portion **28*a* for clearance of the adjacent side rail 73 of the support channel 42 (compare to FIG. 5), and a pair of facing spaced-apart plates 28*b* which form the remainder of the arm and are pivotally mounted at 74 to the bracket 72**.

Figure 10:
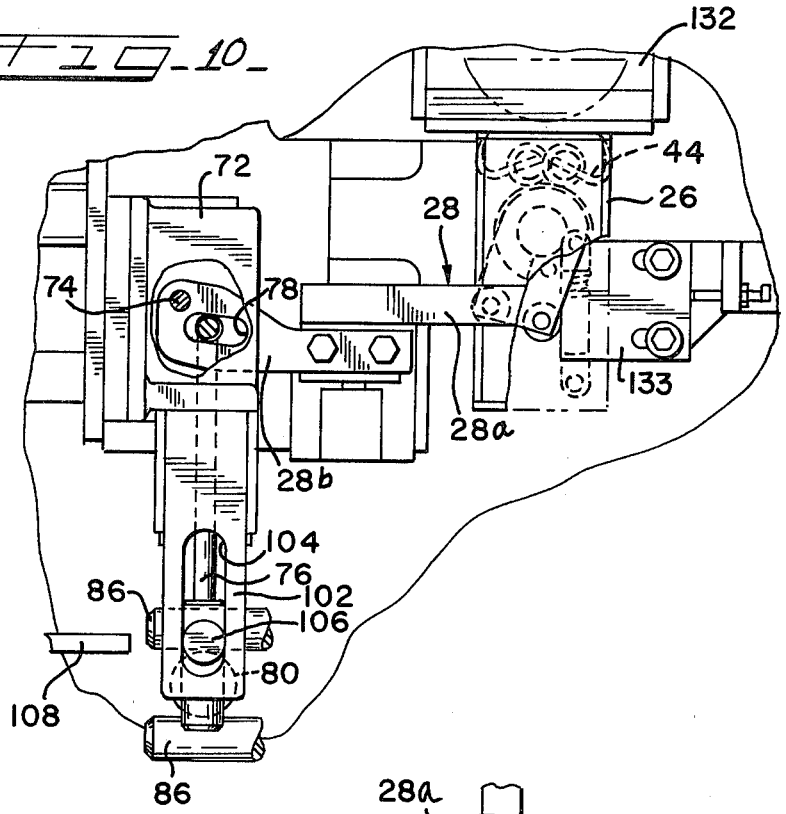
FIG. 10 is a fragmentary plan view, partially in section, of the sausage engaging member and the means for moving the sausage engaging member into and out of registration with the sausage receiving channel.
Figure 11:
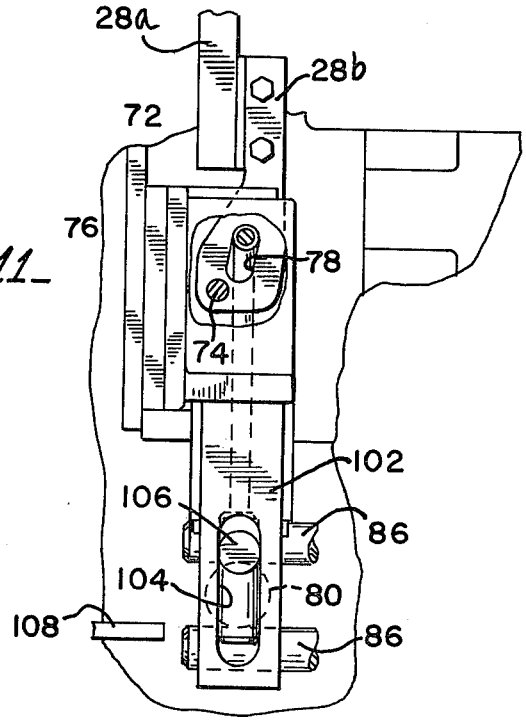
FIG. 11 is an enlarged fragmentary view, with portions removed, to better illustrate the means for pivoting the sausage engaging member of FIG. 10 into and out of registration with the sausage receiving channel.
Figure 13:
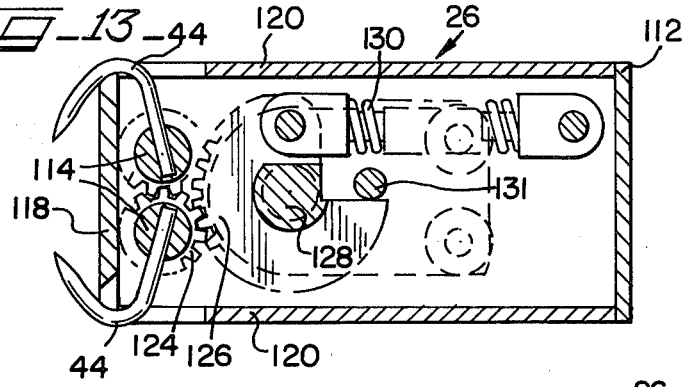
FIG. 13 is a horizontal cross-sectional view of the sausage engaging member taken along line 13—13 of FIG. 12 and depicting the sausage gripping tines in an extended position for gripping the sausage.
Figure 14:
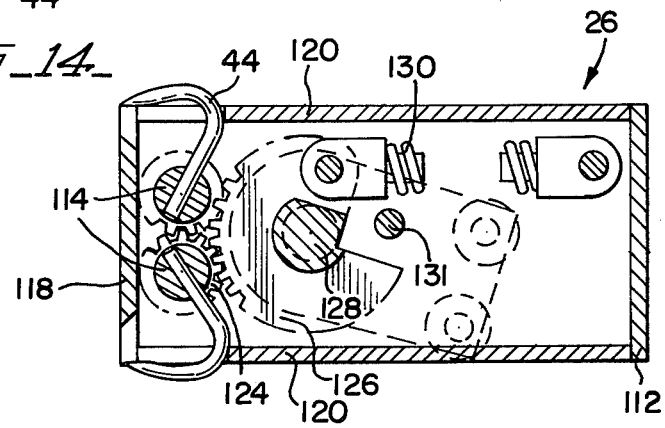
FIG. 14 is the same as FIG. 13, but depicts the tines in a retracted position for release of the butt-end of a sausage.
Figure 12:
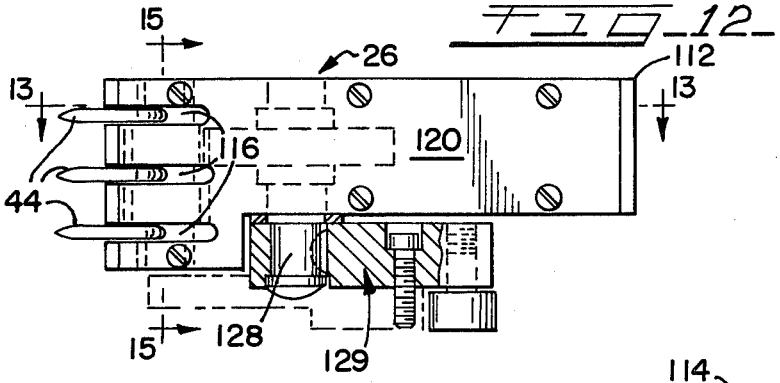
FIG. 12 is a side elevational view of the sausage engaging member employed in the present invention.
Figure 15:
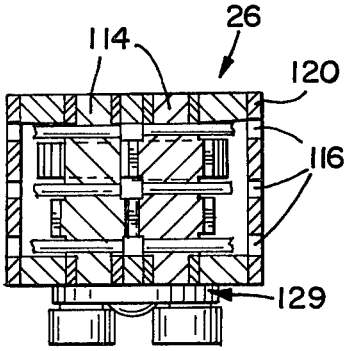
FIG. 15 is a vertical sectional view taken along line 15—15 of FIG. 12.

As best seen in the isolated and enlarged views of FIGS. 10 and 11, the swing arm 28 is caused to pivot either into or out of registration with the sausage support channel 42 by an actuatory arm 76, one end of actuator arm 76 being slidably received within slot 78 in the swing arm. The slot 78 is off-center with respect to the pivot point 74 of the swing arm, so that linear movement of the actuator arm toward the carriage causes the swing arm to pivot 90° into position over the sausage support channel (FIG. 11). Thus, linear movement of the actuator arm away from the carriage retracts the swing arm 90° to a position (FIG. 10) where the swing arm is pointed in the return direction and thus is out of the way for the return stroke and will not interfere with the sausage simultaneously being fed by the other engaging member 26. The upper bracket 72, actuator arm 76 and swing arm portion **28*b*** are available from the DE-STA-CO Division of Dover Corporation, Detroit, Mich., and are commonly referred to as a DE-STA-CO clamp, Model 884 with air cylinder removed.

For moving the actuator arm 76, and thus pivoting of the swing arms 28, each actuatory arm has a depending knob or roller 80 at the outer end which is engageable with the shifters 34 at each end of the slicing apparatus 20. FIG. 5 depicts the shifters at the front of the slicing apparatus for engaging the actuatory arms at the end of the return stroke. The shifters at the other end of the slicing apparatus for engaging the actuatory arms at the end of the feed stroke operate in the same manner as the shifters depicted in FIG. 5. Accordingly, the detailed description will not be repeated for the shifters at the end of the feed stroke.

Figure 8:
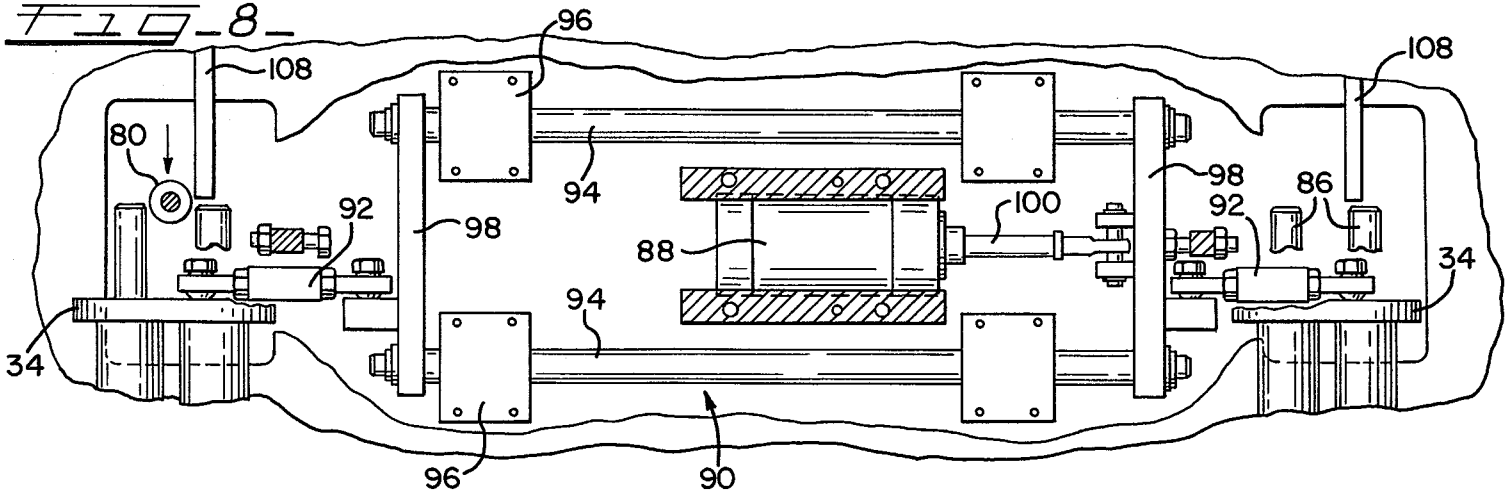
FIG. 8 is a horizontal sectional view on an enlarged scale taken along line 8—8 of FIG. 5 and depicting shifter assemblies for moving the sausage engaging members into and out of registration with the sausage receiving channel.
Figure 9:
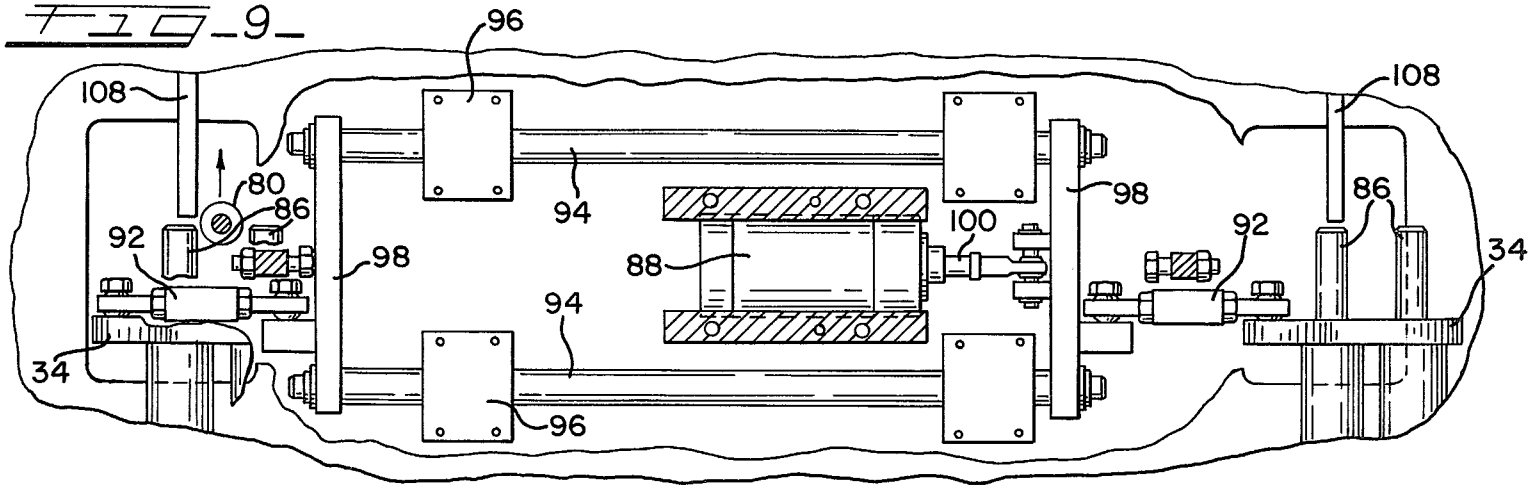
FIG. 9 is the same as FIG. 8, but depicts the shifter assemblies to a position shifted from that in FIG. 8.

As shown in FIG. 5, each shifter 34 is generally triangularly shaped and pivotally mounted at 84 to the slicing apparatus support frame 46. Referring momentarily to FIGS. 8–10, the upper end of each shifter has a pair of rearwardly extending pins 86 with a space therebetween to receive the actuator arm roller 80 when the carriage 30 returns to the start position. With the roller 80 trapped between the pins 86, pivoting the shifter 34 toward the carriage drives the actuator arm in the same direction, and thereby causes the swing arm 28 to pivot 90° to engage the end of a new sausage (FIGS. 9 and 11). Opposite movement of the shifters, as for the shifters at the end of the feed stroke, pivots the swing arm away from the sausage support channel 42 and into a position pointing in the return direction.

Looking at FIGS. 8 and 9, the shifters are pivoted by an air or hydraulic cylinder 88 which is connected to the lower ends of the shifters via slide shuttle, generally at 90, and linkages 92. The slide shuttle comprises a pair of side rods 94 which are slidably mounted in support from bracket 96 and joined at the ends by cross members 98. The cylinder 88 is positioned between the guide bars, and cylinder piston rod 100 is attached to one of the cross members so that the cylinder 88 can reciprocate the shuttle from side to side. The adjustable linkages 92 connect the left and right end cross members of the shuttle with the respective left and right shifts so that when the shuttle is driven to the right, the upper portion of both shifters is pivoted to the left and when the shuttle is driven to the left, the upper portion of both shifters is driven to the right.

The energizing of the cylinder 88 is controlled by limit switches, not shown, which are contacted when the carriages 30 reach the end of the return or feed strokes, i.e., positions A or B. Thus, for example, referring to FIGS. 8 and 10, during return of the left carriage 30, the left shifter 34 is positioned to receive the roller 80 between pins 86. When the carriage reaches the end of the return stroke, with the roller captured between the bosses, the retraction of the cylinder 88 moves the shuttle 90 to the left, thus pivoting the shifters to the right. This action (as also seen in FIG. 11) drives the actuator arm roller 80 to the right, causing the swing arm 28 to pivot to a position over sausage support channel 42 for the feed stroke. This action also positions the right shifter to receive the actuator arm roller of the right carriage at the end of the return stroke.

There are several safeguards associated with each of the actuator arms 76 to assure proper operation. For example, referring back to FIGS. 10 and 11, to prevent accidental rotation of the actuator arm about its axis during repeated reciprocation, an anti-wobble plate 102 extends outwardly from each carriage 30 above the respective actuator arm 76. The anti-wobble plate has a guide slot 104 within which an upstanding follower 106 of the actuator arm is slidably received. Thus, the actuator arm can reciprocate but cannot turn or rotate. In addition, to assure that the swing arm is maintained in the correct position, either in registration with the sausage support 42 during the feed stroke, or out of registration during the return stroke, guide rails 108 are provided which extend the entire length of the apparatus (FIG. 2). The guide rails 108 are positioned to abut the actuatory arm roller 80 during travel between start and stop positions to lock the actuator arm in the desired position. During the feed stroke, the roller 80 is positioned against the inside surface of the rail 108 which assures that the actuator arm 76 cannot accidentally retract to permit the swing arm to pivot out of registration with the sausage support. In the return direction, the roller moves along the outside surface of the rail, which maintains the swing arm in the out-of-registration position, pointed generally in the direction of movement of the carriage 30.

Turning now to FIGS. 12–15, each sausage engaging member 26 has a generally rectangular housing 112 which encloses the mechanism for moving the tines 44 between the extended and retracted positions. The tines preferably are mounted on a pair of upstanding rotatable shafts 114 and extend through slots 116 in the side and front walls 118 and 120 of the housing. The tines are bent back upon themselves so that when in the retracted position (FIG. 14) they do not extend beyond the front wall 118 of the housing. When extended by rotation of the shafts 114 (FIG. 13), the tines extend beyond the front wall and point together to provide a gripping action for gripping the end of a sausage.

The tines 44 are moved between retracted and extended positions by rotation of the shafts 114 on which the tines are mounted. Each of the shafts 114 has meshing lower gears so that when one turns, the other turns in the opposite direction. One of the shafts 114 also has an upper gear 124 which meshes with actuating gear 126. The actuating gear is, in turn, mounted on shaft 128 which extends through the bottom of the housing and is attached to trip member 129. A compressed spring 130 biases the actuating gear 126 against stop 131 so that the tines 44 are normally in an extended position.

Figure 3:
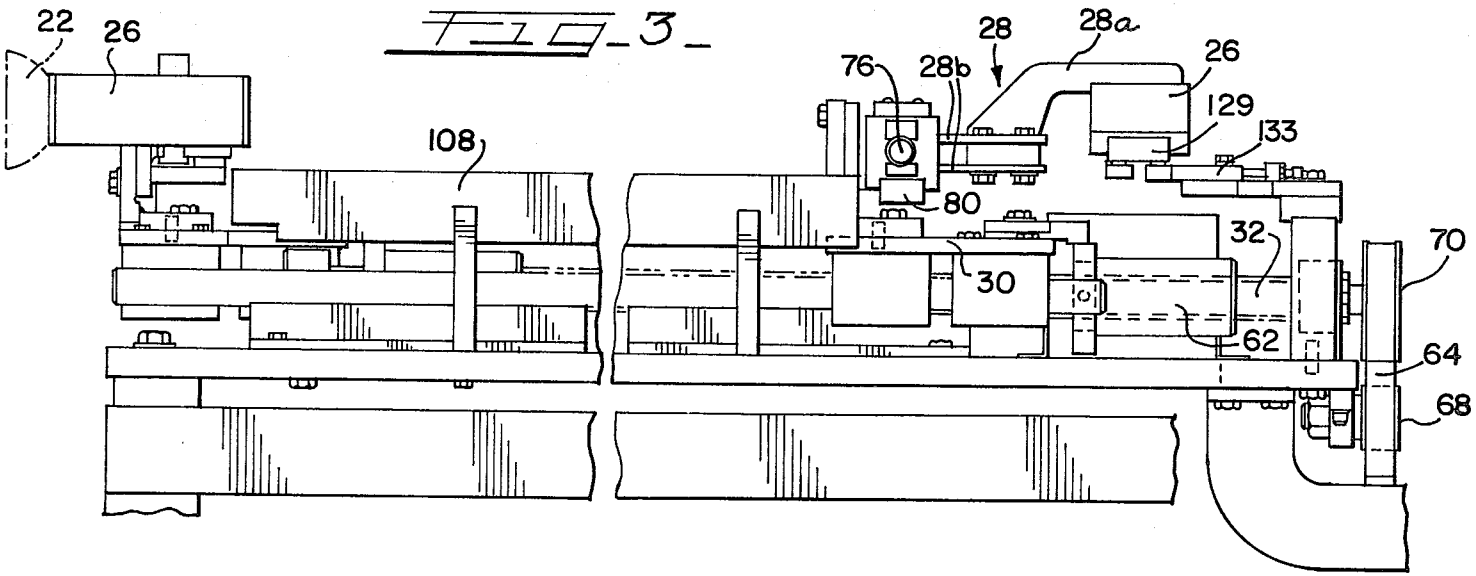
FIG. 3 is a vertical cross-sectional view taken along line 3—3 of FIG. 2.

To move the tines to a retracted position, referring to FIGS. 3 and 10, an abutment member 133 is provided on the slicing apparatus at about the end of the return stroke. The abutment member 133 is positioned to engage and move the trip member 129 to the position shown in dashed lines in FIG. 14, thereby turning the actuator gear 126 and gear shafts 114 to move the tines to the retracted position, which releases the butt-end of the previously sliced sausage. A chute 132 below the sausage engaging member directs the butt-end into a collection hopper.

During operation of the slicing apparatus 20, as noted before, a supply of sausages is loaded into the magazine 36 so that constant operator attention is not required. In the magazine, the next sausage to be fed rests atop stop member 40, and stop member 38 restrains the remaining sausages. Before stop member 40 releases the sausage to drop into the sausage support channel 42, one of the sausage engaging members must be at the start position A, but not yet pivoted into position to engage the sausage, and the sausage engaging member at position B at the other end of the apparatus, which just completed a feed stroke, must have pivoted out of the way, out of registration with the sausage support channel. When these conditions exist, stop member 40 pivots to allow the sausage 22 in the pre-feed position to fall into the sausage support channel 42. The cylinder 88 which controls the front shifters 82 is then energized to drive the shifters to move the actuating arm inwardly, causing the swing arm 28 and sausage engaging member 26 to pivot 90° and engage the butt-end of the sausage in the support channel. The tines 44, which are normally in the gripping position, pierce and grip the butt-end of the sausage. The motor 63 is then energized, simultaneously driving the carriage to push the sausage toward the slicer and returning the other carriage to the start position.

During the feed stroke, the actuator arm roller 80 for the feeding carriage is positioned inside the guide rail 108 which locks the actuator arm and the shifter arm in the position to maintain the sausage engaging member in registration with the support channel. The actuator arm roller for the returning carriage is on the outside of guide rail 108 to assure that the returning sausage engaging member does not interfere with the sausage being fed. When the feed stroke is completed, the rear end shifters are pivoted to shift the actuator arm and pivot the sausage engaging member out of registration with support channel 42 and pointing in the return direction. In the meantime, the returning sausage engaging member has reached start position A and, in doing so, has engaged abutment member 133 which causes the tines to retract and release the butt-end into chute 132. The slicer is now ready for another sausage to be fed from the magazine, and the operation is repeated with the other of the sausage engaging members.

Although described in terms of a preferred embodiment, this invention can be embodied in various forms and, therefore, is to be construed and limited only by the scope of the appended claims.

I claim:

1. In an apparatus for slicing elongated products, the apparatus having (a) elongated product support means for receiving and supporting a product, (b) slicing means at one end of the product support means for slicing the product into a plurality of slices and (c) feeder means movable between a start position spaced from the slicing means and a stop position adjacent to the slicing means to alternately feed the product to the slicing means and return to the start position, the improvement comprising, in combination:

the feeder means including a pair of product engaging members, each of which is positionable in registration with the support means for feeding a product to the slicing means in a direction that is transverse to the cutting path of the slicing means, and out of registration with the support means for returning to the start position, means for driving the product engaging members simultaneously in opposite directions, whereby one product engaging member is returning to the start position while the other product engaging member is feeding the product to the slicing means, and whereby a series of products may be fed in succession to the slicing means without delay for the return of the feeder means, and said feeder means includes a pair of pivot means for positioning said product engaging members in and out of registration with said support means, each said pivot means includes a pivotal swing arm in operative interengagement with one of said product engaging members, said pivotal swing arm pivoting in a direction that is generally parallel to said elongated product support means.

2. An apparatus in accordance with claim 1, further including a magazine for holding a plurality of elongated products and means for automatically discharging the products onto the product support means.

3. An apparatus in accordance with claim 1, wherein the apparatus is for slicing a sausage product.

4. In an apparatus for slicing elongated products, the apparatus having (a) elongated product support means for receiving and supporting a product, (b) slicing means at one end of the product support means for slicing the product into a plurality of slices and (c) feeder means movable between a start position spaced from the slicing means and a stop position adjacent to the slicing means to alternately feed the product to the slicing means and return to the start position, the improvement comprising, in combination:

the feeder means including a pair of product engaging members, each of which is positionable in registration with the support means for feeding a product to the slicing means in a direction that is transverse to the cutting path of the slicing means, and out of registration with the support means for returning to the start position, means for driving the product engaging members simultaneously in opposite directions, whereby one product engaging member is returning to the start position while the other product engaging members is feeding the product to the slicing means, and whereby a series of products may be fed in succession to the slicing means without delay for the return of the feeder means, and a magazine for holding a plurality of elongated products and means for automatically discharging the products onto the product support means, wherein the magazine includes an inclined bottom wall upon which the products rest, and a rear wall spaced from the rearward edge of the bottom wall to define an elongated product passageway which is located above the product support means, and wherein the means for discharging products includes a first product retaining member operative to prevent passage of a product into the product passageway, a second product retaining member operative to prevent a product in the passageway from dropping onto the product support means, and means for operating the first and second retaining members alternately to prevent passage of product into the passageway while permitting a product in the passageway to fall onto the support means, and to permit a product to pass into the passageway while preventing any product from dropping from the passageway onto the support means.

5. An apparatus in accordance with claim 4, wherein the first product retaining member includes a pivotally mounted plate located above the rearward edge of the bottom wall and movable to engage and restrain the product located nearest the rearward edge from rolling into the passageway, and the second product retaining member includes a pivotally mounted plate located substantially adjacent the rearward edge of the bottom plate and movable to at least partially block the space between the rearward edge of the rear wall to prevent a product from dropping through the space.

6. In an apparatus for slicing elongated products, the apparatus having (a) an elongated product support means for receiving and supporting a product, (b) slicing means at one end of the product support means for slicing the product into a plurality of slices and (c) feeder means movable between a start position spaced from the slicing means and a stop position adjacent to the slicing means to alternately feed the product to the slicing means and return to the start position, the improvement comprising, in combination:

the feeder means including a pair of product engaging members, each of which is positionable in registration with the support means for feeding a product to the slicing means, and out of registration with the support means for returning to the start position, means for driving the product engaging members simultaneously in opposite directions, whereby one product engaging member is returning to the start position while the other product engaging member is feeding the product to the slicing means, and whereby a series of products may be fed in succession to the slicing means without delay for the return of the feeder means, the product engaging members are carried on either side of the product support means, and said product engaging members are each pivotally mounted with respect to the product support means to swing into registration with the product support means at the start position to feed a product from the support means to the slicing means and to swing out of registration with the support means at the stop position for return, and pivot means is provided for said pivotal mounting of the product engaging members, said pivot means includes a pivotal swing arm in operative interengagement with one of said product engaging members, and said pivotal swing arm is pivotable in a direction that is generally parallel to said elongated product support means.

7. In an apparatus for slicing elongated products, the apparatus having (a) elongated product support means for receiving and supporting a product, (b) slicing means at one end of the product support means for slicing the product into a plurality of slices and (c) feeder means movable between a start position spaced from the slicing means and a stop position adjacent to the slicing means to alternately feed the product to the slicing means and return to the start position, the improvement comprising, in combination:

the feeder means including a pair of product engaging members, each of which is positionable in registration with the support means for feeding a product to the slicing means, and out of registration with the support means for returning to the start position, means for driving the product engaging members simultaneously in opposite directions, whereby one product engaging member is returning to the start position while the other product engaging member is feeding the product to the slicing means, and whereby a series of products may be fed in succession to the slicing means without delay for the return of the feeder means, and the product engaging members are carried by pivot means on either side of the product support means, each of the pivot means including a pivotal swing arm mounting one of the product engaging members and a reciprocating actuator arm operatively connected to the swing arm to move the swing arm out of and into registration with the product support means when the actuator arm is pushed and pulled, said pivotal swing arm pivoting in a direction that is generally parallel to said elongated product support means.

8. In an apparatus for slicing elongated products, the apparatus having (a) elongated product support means for receiving and supporting a product, (b) slicing means at one end of the product support means for slicing the product into a plurality of slices and (c) feeder means movable between a start position spaced from the slicing means and a stop position adjacent to the slicing means to alternately feed the product to the slicing means and return to the start position, the improvement comprising, in combination:

the feeder means including a pair of product engaging members, each of which is positionable in registration with the support means for feeding a product to the slicing means, and out of registration with the support means for returning to the start position, means for driving the product engaging members simultaneously in opposite directions, whereby one product engaging member is returning to the start position while the other product engaging member is feeding the product to the slicing means, and whereby a series of products can be fed in succession to the slicing means without delay for the return of the feeder means, the product engaging members are carried by pivot means on either side of the product support means, each of the pivot means including a pivotal swing arm mounting one of the product engaging members and a reciprocating actuator arm operatively connected to the swing arm to move the swing arm out of and into registration with the product support means when the actuator arm is pushed and pulled, wherein each of the actuator arms includes a follower member, the apparatus further including a rail extending between the start and stop positions on each side of the product support means and positioned so that the follower member of the respective actuator arm will be maintained on one side of the rail when moving in the feed direction and on the other side when moving in the return direction, thereby preventing accidental movement of the product engaging members into or out of registration with the support means.

9. In an apparatus for slicing elongated products, the apparatus having (a) elongated product support means for receiving and supporting a product, (b) slicing means at one end of the product support means for slicing the product into a plurality of slices and (c) feeder means movable between a start position spaced from the slicing means and a stop position adjacent to the slicing means to alternately feed the product to the slicing means and return to the start position, the improvement comprising, in combination:

the feeder means including a pair of product engaging members, each of which is positionable in registration with the support means for feeding a product to the slicing means and out of registration with the support means for returning to the start position, means for driving the product engaging members simultaneously in opposite directions, whereby one product engaging member is returning to the start position while the other product engaging member is feeding the product to the slicing means, and whereby a series of products may be fed in succession to the slicing means without delay for the return of the feeder means, the product engaging members are carried by pivot means on either side of the product support means, each of the pivot means including a pivotal swing arm mounting one of the product engaging members and a reciprocating actuator arm operatively connected to the swing arm to move the swing arm out of and into registration with the product support means when the actuator arm is pushed and pulled, a shifter at the start and stop positions for each of the pivot means, the shifter being engageable with the actuator arm to move the swing arm into and out of registration with the product support means, the actuator arm including an attached follower member and the shifter having a follower-receiving recess and being movable to push or pull the follower member and the actuator arm into or out of registration with the product support means.

10. An apparatus in accordance with claim 9, wherein the shifters are pivotally mounted onto the apparatus, the apparatus further including shifting means extending between the shifters at each start position and between the shifters at the stop position so that movement of the shifting means causes simultaneous movement of both shifters to which the shifting means is connected.

11. In an apparatus for slicing elongated products, the apparatus having (a) elongated product support means for receiving and supporting a product, (b) slicing means at one end of the product support means for slicing the product into a plurality of slices and (c) feeder means movable between a start position spaced from the slicing means and a stop position adjacent to the slicing means to alternately feed the product to the slicing means and return to the start position, the improvement comprising, in combination:

the feeder means including a pair of product engaging members, each of which is positionable in registration with the support means for feeding a product to the slicing means, and out of registration with the support means for returning to the start position, means for driving the product engaging members simultaneously in opposite directions, whereby one product engaging member is returning to the start position while the other product engaging member is feeding the product to the slicing means, and whereby a series of products may be fed in succession to the slicing means without delay for the return of the feeder means, the product engaging members are carried on either side of the product support means, and said product engaging members are each pivotally mounted with respect to the product support means to swing into registration with the product support means at the start position to feed a product from the support means to the slicing means and to swing out of registration with the support means at the stop position for return, and a pair of oppositely threaded drive screws are mounted on either side of the support means, each of the product engaging members being supported by a carrier threadedly engaged with one of the drive screws whereby rotation of the drive screws in the same direction causes the carrier and the product engaging members to move in opposite directions.

12. In an apparatus for slicing elongated products, the apparatus having (a) elongated product support means for receiving and supporting a product, (b) slicing means at one end of the product support means for slicing the product into a plurality of slices and (c) feeder means movable between a start position spaced from the slicing means and a stop position adjacent to the slicing means to alternately feed the product to the slicing means and return to the start position, the improvement comprising, in combination:

the feeder means including a pair of product engaging members, each of which is positionable in registration with the support means for feeding a product to the slicing means in a direction that is transverse to the cutting path of the slicing means, and out of registration with the support means for returning to the start position, means for driving the product engaging members simultaneously in opposite directions, whereby one product engaging member is returning to the start position while the other product engaging member is feeding the product to the slicing means, and whereby a series of products may be fed in succession to the slicing means without delay for the return of the feeder means, and each of the product engaging members includes housing means and a plurality of gripper tines carried in the housing means and movable between an extended position to grip the end of a product and to a retracted position to release the end of the product.

13. An apparatus for slicing elongated products, the apparatus having (a) elongated product support for receiving and supporting a sausage product, (b) a slicer at one end of the product support for slicing the product into a plurality of slices and (c) feeder means movable back and forth between a start position spaced from the slicer and a stop position adjacent the slicer to feed a product to the slicer and return to the start position, the improvement comprising, in combination:

the feeder means including a pair of pivot means disposed on either side of the product support and movable generally parallel to the product support between the start and stop positions, said pivot means including a pivotal swing arm and a push-pull actuator arm operatively connected to the swing arm to move the swing arm into and away from a position above the product support;

a product engaging member carried by the pivot arm;

a rail positioned on each side of the product support and extending generally parallel to the product support between the start and stop positions;

the actuator arm further including a fixed cam follower disposed to reside on one side of the rail when the swing arm is positioned above the product support for movement in the feed direction and on the other side of the rail when the swing arm is positioned away from the product support for return;

a shifter mounted at each end of the rails and including means for receiving the cam follower, the shifter being laterally movable to shift the cam follower and the actuator arm to cause the desired pivot of the swing arm;

means for driving the pivot means simultaneously in opposite directions, whereby one of the product engaging members is returning to the start position while the other product engaging member is feeding a product to the slicer; and a magazine carried above the product support for holding a plurality of products, including means for automatically discharging a product onto the product support in timed relationship to the movement of the product engaging members, whereby a series of products may be fed in succession to the slicer.

14. An apparatus in accordance with claim 13, wherein the magazine includes an inclined bottom wall upon which the products rest, and a rear wall spaced from the rearward edge of the bottom wall and defining an elongated product passageway which is located above the product support, and the means for discharging products includes a first product retaining member operative to prevent passage of a product into the product passageway, a second product retaining member operative to prevent a product in the product passageway from dropping onto the product support means, and means for operating the first and second retaining members alternately to prevent passage of products into the passageway while permitting a product in the passageway to fall onto the support means, and to permit a product to pass into the passageway while preventing any product from dropping from the passageway onto the support means.

15. An apparatus in accordance with claim 14, wherein the first product retaining member includes a pivotally mounted plate located above the rearward edge of the bottom wall and movable to engage and restrain the product located nearest the rearward edge from dropping into the passageway, and the second product retaining member includes a pivotally mounted plate located substantially adjacent the rearward edge of the bottom plate and movable to at least partially block the space between the rearward edge and the rear wall to prevent a product from dropping through the space.

16. A method for feeding elongated food products to a slicer, wherein the method comprises the steps of:

placing an elongated food product on an elongated product support in an apparatus having a pair of product engaging members which are movable parallel to the product support and are movable into and out of registration with the product support, the slicer being adjacent one end of the product support;

moving the first product engaging member through a path that is generally parallel to the elongated product support and into registration with the product support to engage the food product, the second product engaging member being moved out of registration with the product support;

moving the first product engaging member toward the slicer to feed the food product to the slicer while simultaneously moving the second product engaging member away from the slicer, until the food product is substantially sliced;

moving the first product engaging member out of registration with the product support;

placing a second elongated food product on the product support;

moving the second product engaging member through a path that is generally parallel to the elongated product support and into registration with the product support to engage the second food product;

moving the second product engaging member toward the slicer to feed the second food product to the slicer while simultaneously moving the first product engaging members away from the slicer, until the second food product is substantially sliced.

17. A method in accordance with claim 16, further including pivotally mounting the product engaging members to swing into and out of registration with the product support.

18. A method in accordance with claim 17, further including carrying the product engaging members on a pivotally mounted swing arm which is operatively connected to a reciprocating actuator arm, and movement of the product engaging members is achieved by reciprocating the actuator arm.

19. A method in accordance with claim 18, further including locking the respective actuator arm in the selected position during movement of the product engaging member toward and away from the slicer.

20. A method in accordance with claim 16, further including storing a plurality of elongated food products and automatically discharging the products for placement onto the product support.

21. A method in accordance with claim 16, further including the step of gripping the end of the elongated food product being fed with the product engaging member.

22. A method in accordance with claim 16, wherein the placing step includes selecting an elongated food product that is a sausage product.

23. A method for feeding elongated food products to a slicer, wherein the method comprises the steps of:

placing a product on an elongated product support in an apparatus having a pair of product engaging members which are movable parallel to the product support and are movable into and out of registration with the product support, the slicer being adjacent one end of the product support;

moving the first product engaging member through a path that is generally parallel to the elongated product support and into registration with the product support to engage the product, the second product engaging member being moved out of registration with the product support;

gripping the end of the product being fed with the product engaging member;

moving the first product engaging member toward the slicer to feed the product to the slicer while simultaneously moving the second product engaging member away from the slicer, until the product is substantially sliced;

moving the first product engaging member out of registration with the product support;

placing a second product on the product support;

moving the second product engaging member through a path that is generally parallel to the elongated product support and into registration with the product support to engage the second product;

moving the second product engaging member toward the slicer to feed the second product to the slicer while simultaneously moving the first product engaging member away from the slicer, until the second product is substantially sliced; and releasing the end of the product after the product engaging member has moved away from the slicer.

24. A method for feeding elongated food products to a slicer, wherein the method comprises the steps of:

placing a product on an elongated product support in an apparatus having a pair of product engaging members which are movable parallel to the product support and are movable into and out of registration with the product support, the slicer being adjacent one end of the product support;

moving the first product engaging member through a path that is generally parallel to the elongated product support and into registration with the product support to engage the product, the second product engaging member being moved out of registration with the product support;

moving the first product engaging member toward the slicer to feed the product to the slicer while simultaneously moving the second product engaging member away from the slicer, until the product is substantially sliced;

moving the first product engaging member out of registration with the product support;

placing a second product on the product support;

moving the second product engaging member through a path that is generally parallel to the elongated product support and into registration with the product support to engage the second product;

moving the second product engaging member toward the slicer to feed the second product to the slicer while simultaneously moving the first product engaging members away from the slicer, until the second product is substantially sliced; and supporting each of the product engaging members by a carriage threadedly engaged with one of a pair of oppositely threaded drive screws and the step of moving the product engaging members is achieved by rotating the pair of drive screws in the same direction.

* * * * *

UNITED STATES PATENT AND TRADEMARK OFFICE

CERTIFICATE OF CORRECTION

PATENT NO. : 4,457,194

DATED : July 3, 1984

INVENTOR(S) : Timothy G. Mally

It is certified that error appears in the above-identified patent and that said Letters Patent are hereby corrected as shown below:

At column 3, line 18, "carriage" should read --carriages--.

At column 3, line 65, "or" should read --of--.

At column 4, line 17, "length" should read --lengths--.

At column 6, line 52, "shifts" should read --shifters--.

At column 11, line 38, "can" should read --may--.

Signed and Sealed this

*Nineteenth* Day of *February 1985*

[SEAL]

*Attest:*

DONALD J. QUIGG

*Attesting Officer* *Acting Commissioner of Patents and Trademarks*